US008746213B2

(12) United States Patent
Agneray et al.

(10) Patent No.: US 8,746,213 B2
(45) Date of Patent: Jun. 10, 2014

(54) FLUID INJECTION DEVICE

(75) Inventors: Andre Agneray, Boulogne (FR); Nadim Malek, Versailles (FR); Marc Pariente, Paris (FR); Laurent Levin, Paris (FR)

(73) Assignee: Renault S.A.S., Boulogne Billancourt (FR)

( * ) Notice: Subject to any disclaimer, the term of this patent is extended or adjusted under 35 U.S.C. 154(b) by 1227 days.

(21) Appl. No.: 12/602,268

(22) PCT Filed: May 29, 2008

(86) PCT No.: PCT/FR2008/050950
§ 371 (c)(1),
(2), (4) Date: Oct. 21, 2010

(87) PCT Pub. No.: WO2008/152314
PCT Pub. Date: Dec. 18, 2008

(65) Prior Publication Data

US 2011/0023827 A1 Feb. 3, 2011

(30) Foreign Application Priority Data

May 31, 2007 (FR) ..... 07 03887

(51) Int. Cl.

| | |
|---|---|
| ***F02M 69/04*** | (2006.01) |
| ***B05B 1/08*** | (2006.01) |
| ***F02M 45/10*** | (2006.01) |
| ***F02M 61/08*** | (2006.01) |

(52) U.S. Cl.
CPC ..... *F02M 45/10* (2013.01); *F02M 2200/21* (2013.01); *F02M 61/08* (2013.01); *F02M 69/041* (2013.01)
USPC ..... 123/445; 239/102.1; 239/102.2

(58) Field of Classification Search
USPC ..... 60/725; 123/490, 494, 498, 499; 239/102.2, 585.1, 585.4, 585.5; 310/316.03, 317, 323.06, 374
See application file for complete search history.

(56) References Cited

U.S. PATENT DOCUMENTS 5,169,067 A * 12/1992 Matsusaka et al. ..... 239/102.2
5,199,641 A * 4/1993 Hohm et al. ..... 239/102.2

(Continued)

FOREIGN PATENT DOCUMENTS

DE 198 54 508 5/2000
DE 19854508 C1 * 5/2000 ..... G01F 11/06

(Continued)

OTHER PUBLICATIONS

U.S. Appl. No. 13/119,259, filed Mar. 16, 2011, Agneray, et al.

(Continued)

*Primary Examiner* — Stephen K Cronin
*Assistant Examiner* — Elizabeth Hadley
(74) *Attorney, Agent, or Firm* — Oblon, Spivak, McClelland, Maier & Neustadt, L.L.P.

(57) ABSTRACT

An injector including a nozzle that includes an opening and a seat, a needle movably mounted in the nozzle and having an end defining a valve in a contact area with the seat, a mechanism for vibrating the valve, a first acoustic-impedance breaking area at a first distance from the valve along the nozzle, and another first acoustic-impedance breaking area at a second distance from the valve along the needle. Each of the first and second distances is such that the respective propagation time of acoustic waves along the distance is: $T_i=n_i*[\zeta/2]$, where $n_i$ is a positive integer coefficient different from zero with i=3 for the first distance and i=4 for the second distance, $\zeta$ being a period of the vibrations.

19 Claims, 11 Drawing Sheets

(56) References Cited

U.S. PATENT DOCUMENTS

Figure 1:
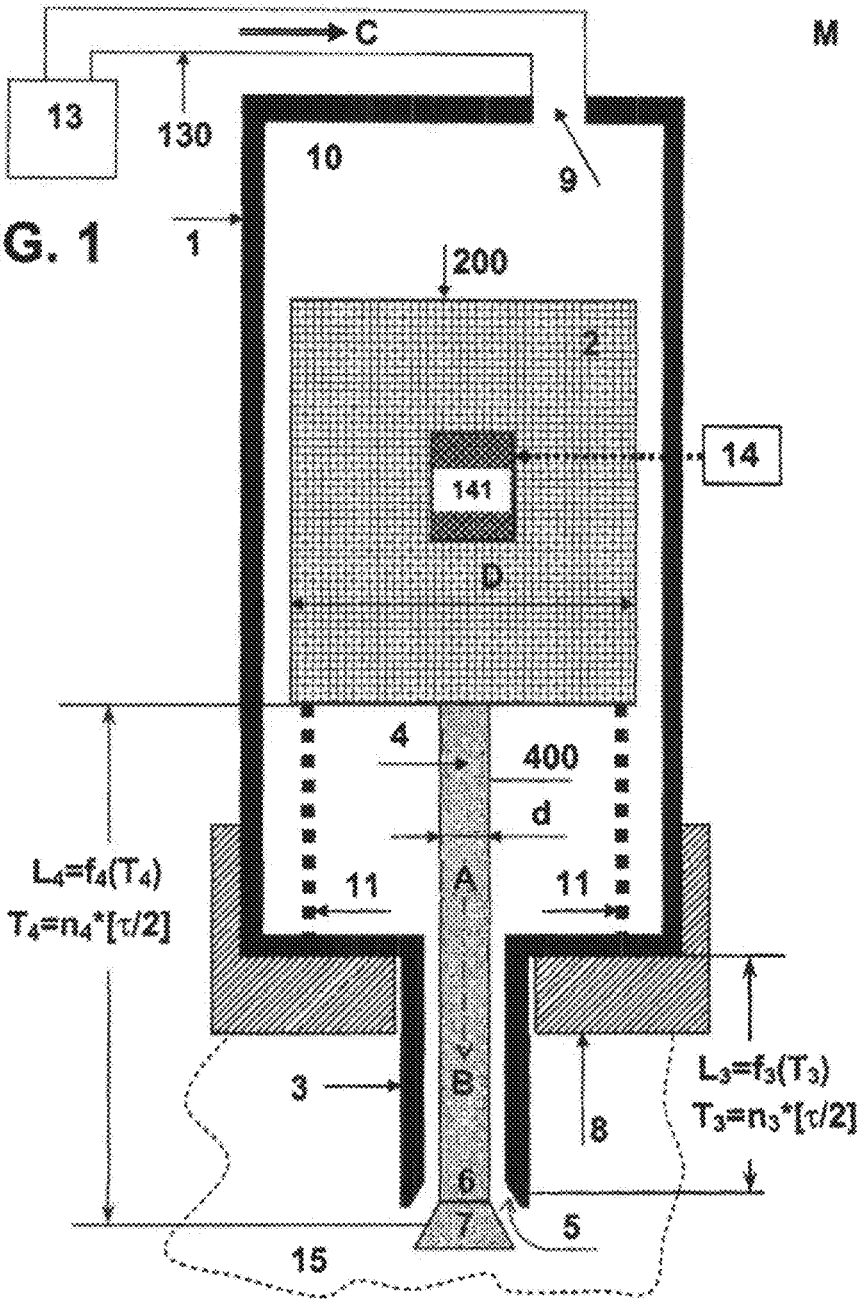

| | | | | |
|---|---|---|---|---|
| 6,612,539 | B1 * | 9/2003 | Ruehle et al. | 251/64 |
| 6,820,431 | B2 * | 11/2004 | McManus et al. | 60/776 |

FOREIGN PATENT DOCUMENTS

| | | | | |
|---|---|---|---|---|
| EP | 0 361 480 | | 4/1990 | |
| FR | 2 832 189 | | 5/2003 | |
| FR | 2832189 | A1 * | 5/2003 | F02M 61/14 |
| GB | 2 327 982 | | 2/1999 | |
| GB | 2327982 | A * | 2/1999 | |

OTHER PUBLICATIONS

U.S. Appl. No. 12/666,671, filed Dec. 24, 2009, Agneray, et al.

* cited by examiner

FLUID INJECTION DEVICE

The invention relates to a device for injecting a fluid, for example, a fuel, in particular for an internal combustion engine.

More precisely, the invention relates, according to a first of its aspects, to a fluid injection device comprising:

- a nozzle having a length on an axis and comprising an injection orifice and a seat, the nozzle being, at the opposite end on said axis, connected to a first body,
- a needle having, on said axis, a length and a first end defining a valve element, in a zone of contact with the seat, the needle being, at the opposite end on this axis, connected to a second body mounted so as to move axially in the first body,
- means for vibrating in order to vibrate with a setpoint period $\tau$ the first end and/or the nozzle, thereby ensuring between them, on said axis, a relative movement suitable for opening and closing the valve alternatively, the nozzle with the first body and the needle with the second body respectively forming a first and a second media for propagating acoustic waves, each medium having a linear acoustic impedance defined by the following equation: $I=\Sigma*\rho*c$, where $\Sigma$ is a surface of a section of the medium perpendicular to the axis, $\rho$ is a density of the medium, c is a velocity of the sound in the medium,
- at least one zone of linear acoustic impedance breakage existing at a distance from the zone of contact of the seat with the first end along the nozzle or the first body, and at least one other zone of linear acoustic impedance breakage existing at a distance from the zone of contact of the first end with the seat along the needle or the second body, and
- said zone and other zone of linear acoustic impedance breakage each being first in the order from said zone of contact between the first end of the needle and the seat, in a direction of propagation of the acoustic waves that is oriented respectively toward the first body and second body.

Such an injection device, called an injector, makes it possible to obtain a cyclic opening with the setpoint period $\tau$, at a controlled frequency that is for example ultrasonic and at a controlled amplitude, of the valve element of the injector, in particular during an established speed of its operation, that is to say during operation at a predetermined temperature outside the starting and stopping phases of the injector. A layer formed by the fluid escaping from the nozzle at the opening of the valve element is broken up and forms fine droplets. In an application of the injector in which it sprays fuel into a combustion chamber, the fine droplets promote a more homogeneous air-fuel mixture, which makes the engine less polluting and more economical.

According to known devices, the cyclical opening of the valve element is carried out with the aid of conventional vibration means, for example piezoelectric and/or magnetostrictive means with corresponding excitation means. The vibration means are arranged, for example, in an actuator converting an electric energy first into vibrations with the setpoint period $\tau$ of the actuator, then into longitudinal alternating movement with the setpoint period $\tau$ of the needle and therefore of its first end thus excited, relative to the seat of the nozzle. In order to provide a sufficient flow rate of fuel when the valve element opens, it is necessary for the head of the needle and the nozzle to be made to resonate substantially in phase opposition. For this the characteristic lengths of the needle and that of the nozzle are chosen, in a known manner, so that the acoustic wave propagation times in respective materials forming the needle and the nozzle are equal to a quarter of the period of the vibrations $\tau/4$ or to odd multiples of said quarter of the period, that is to say equal to $[2n+1]*\tau/4$ with a positive, non-zero integer multiplying coefficient n. A resonating "needle/nozzle" structure thus formed generates high amplitudes of opening of the valve element at low pressures, for example, equal to or less than 5 MPa, in the combustion chamber. Gradually as the fuel is injected during a compression cycle, the pressure in the combustion chamber and, consequently, a backpressure at the valve element, increases. This backpressure may also vary according to the point of operation of the engine. With the increase in the backpressure, the intensity of the impacts of the first end of the needle on its seat, even damped by the layer of fuel, becomes ever greater. The feedback of these impacts in the resonating "needle/nozzle" structure as a conventional quarter wavelength $[2n+1]*\tau/4$ induces a coupling between the impact and a lifting of the first end of the needle from its seat by modifying the amplitude of opening of the valve element. If the impacts persist, the lifting of the head becomes chaotic. The benefit of the resonances is lost. The opening of the valve element becomes disordered which may render the fuel flow rate difficult to control.

In this context, the object of the present invention is to propose a fluid injection device designed at least to reduce at least one of the abovementioned limitations. For this purpose, it is in particular proposed, on the injection device according to the generic definition given thereto by the above preamble, that:

- the distance, called the first distance, between on the one hand the zone of contact between the seat and the first end, and on the other hand the first zone of linear acoustic impedance breakage along the nozzle or the first body, is such that the propagation time $T_3$ of the acoustic waves initiated by the vibration means and traveling over this first distance satisfies the following equation: $T_3=n_3*[\tau/2]$, where $n_3$ is a multiplying coefficient, a non-zero positive integer, and
- the distance, called the second distance, between on the one hand the zone of contact between the first end and the seat, and on the other hand the first zone of linear acoustic impedance breakage along the needle or the second body, is such that the propagation time $T_4$ of the acoustic waves initiated by the vibration means and traveling over this second distance satisfies the following equation: $T_4=n_4*[\tau/2]$, where $n_4$ is a multiplying coefficient, a non-zero positive integer.

By virtue of this arrangement of the injector, called wave half-period, the echoes of the impacts return with exclusively whole multiple delays of the setpoint period $\tau$ of excitation of the needle. The impacts produced at the seat of the nozzle by the backpressure waves in the combustion chamber can be likened to a condition in which the stresses become very high. This situation is similar to conditions at the limits of the "blocked displacement" type representative of the injector at wave half-period for which the displacement is zero and the stress can be of any value. The impacts of the first end of the needle on the seat are then propagated in the nozzle and return to phase one period later, which dynamically keeps the seat of the injector immobile. The opening of the valve element and, in particular the amplitude of this opening, will then be not very sensitive to the backpressure. The result of this is better control of the fuel flow rate by the injector.

According to another aspect, the invention relates to an internal combustion engine using the fluid injection device according to the invention, that is to say such an engine in which this injection device is placed.

The injector may have a needle the first end of which is extended longitudinally at the opposite end of the second body by a head called an outward facing head, and also a needle the first end of which is extended longitudinally at the other end of the second body by a head called an inward facing head.

The needle with the outgoing head has a divergent flared shape in a direction of the axis of the injector oriented from the first body to the outside of the nozzle in the combustion chamber. Preferably, the needle with the outgoing head has a frustoconical divergent flared shape. The outgoing head closes off the seat on the outside of the nozzle oriented away from the first body, in the direction of the axis of the injector.

The needle with the incoming head narrows in the direction of the axis oriented from the first body to the outside of the nozzle and closes off the seat on the inside of the nozzle oriented toward the first body. Since the head is narrowed, its surface is less exposed to the backpressure waves. Similarly, it weighs less, which minimizes an amplitude of the stresses on the seat at the moment of impact. Assembly of the injector is made easier because the needle with the incoming head can first be mounted on the second body comprising the actuator, then inserted into the first body. The needle with the incoming head tends to be placed on the seat under the effect of gravity. The injector therefore operates in positive safety. In the event of a defect of the return means of the second body, or even in their absence, the valve element remains in the closed position thus sealing the injector with the outgoing head. Moreover, an accidental breakage of the needle means that its broken portion remains in the body of the injector without the risk of falling into a cylinder of the engine.

Figure 2:
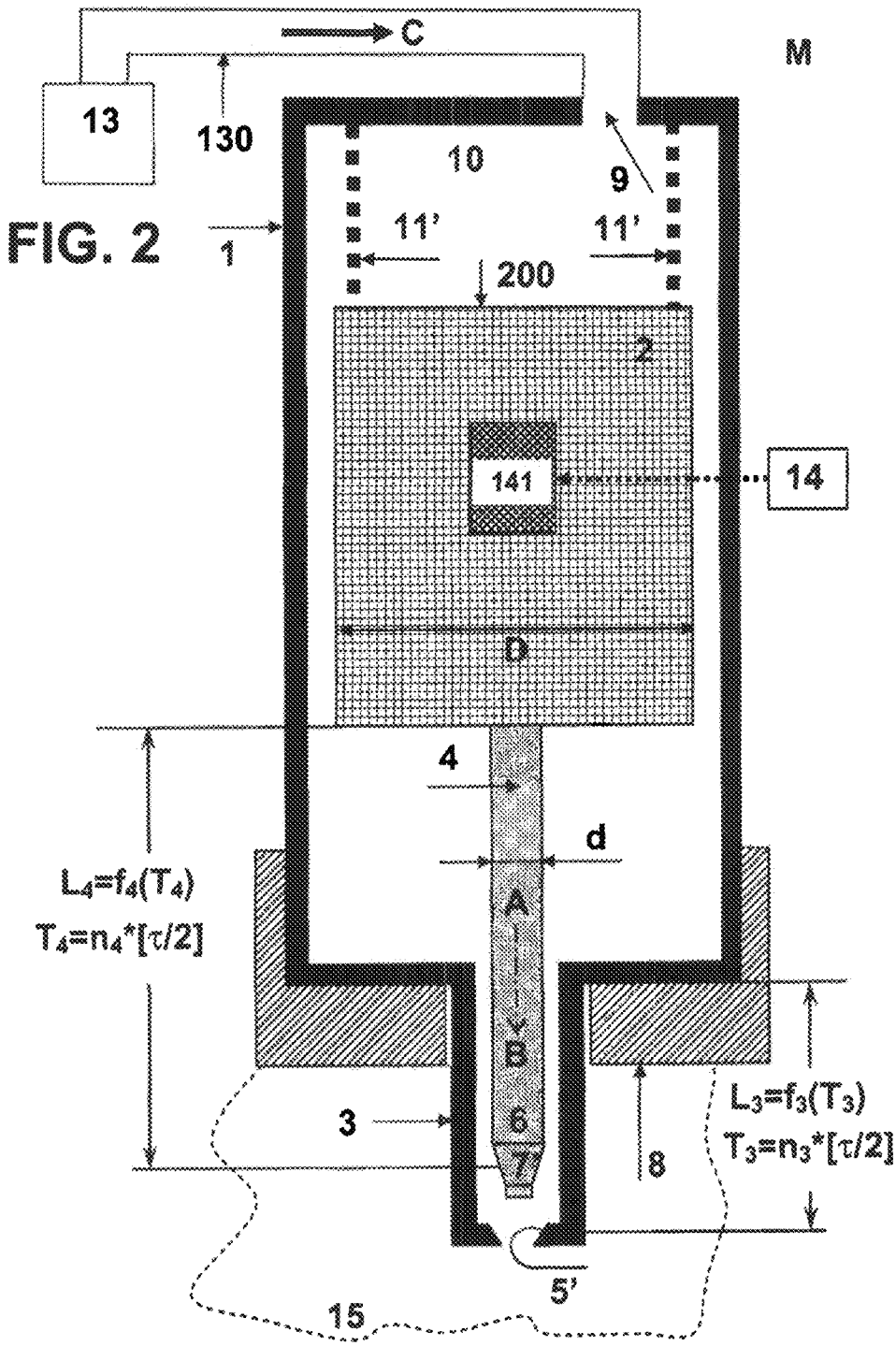
Figure 3:
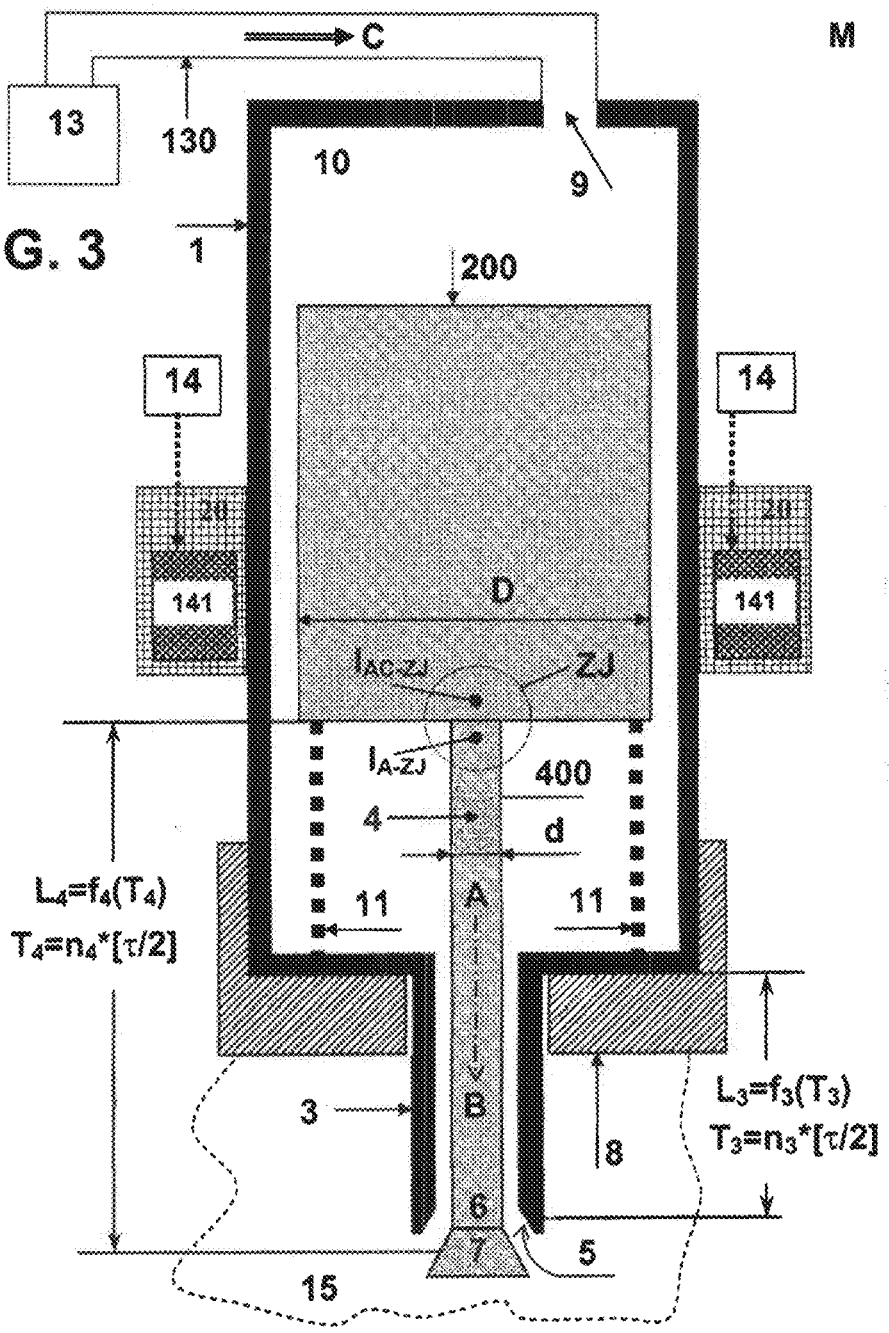
Figure 4:
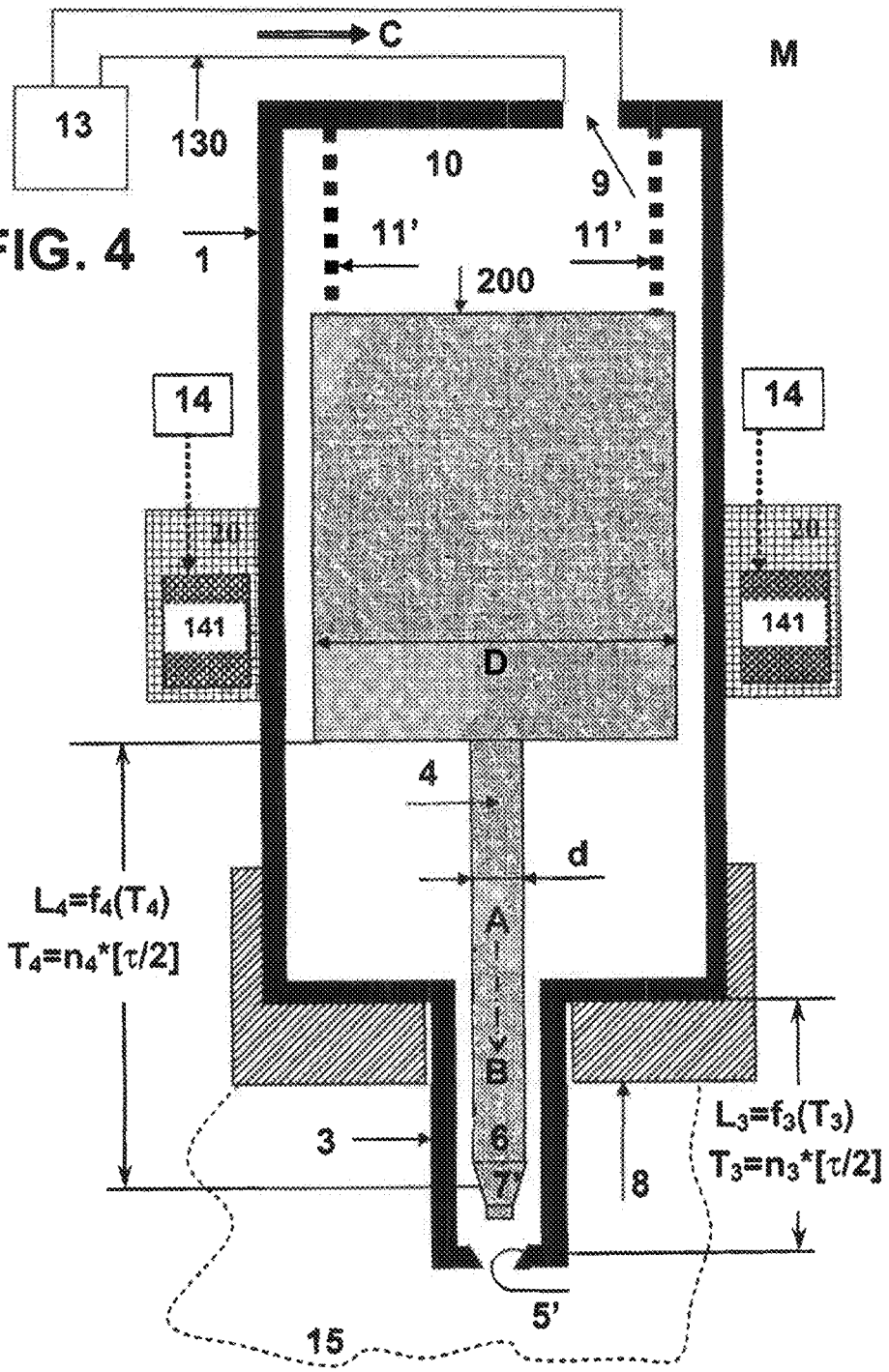
Figure 5:
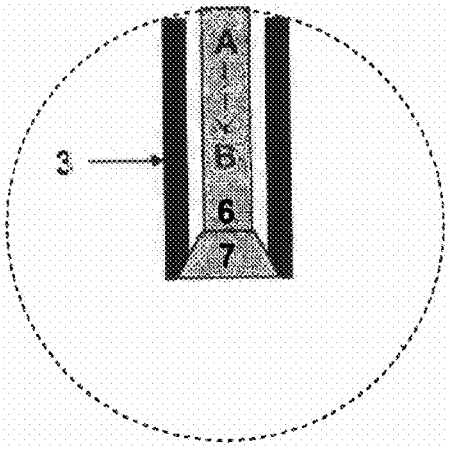
Figure 7:
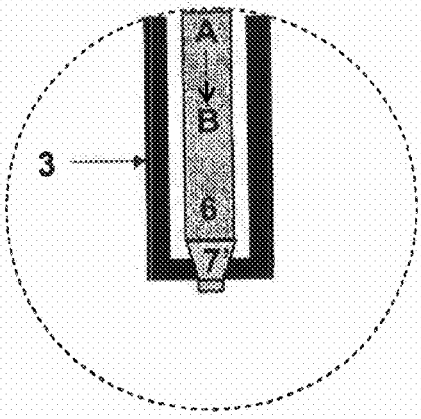
Figure 6:
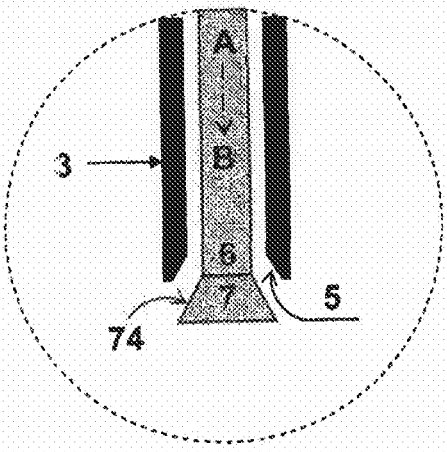
Figure 8:
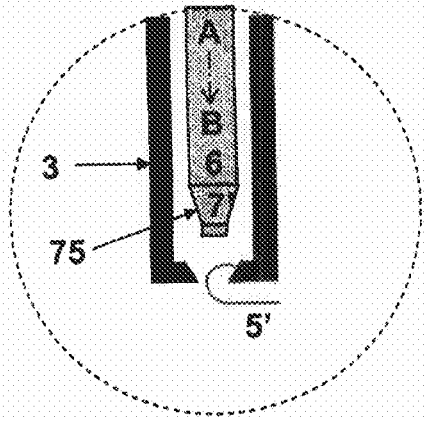
Figure 9:
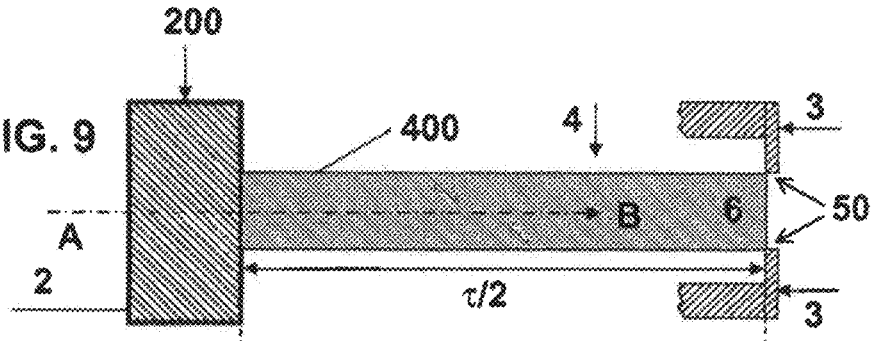
Figure 10:
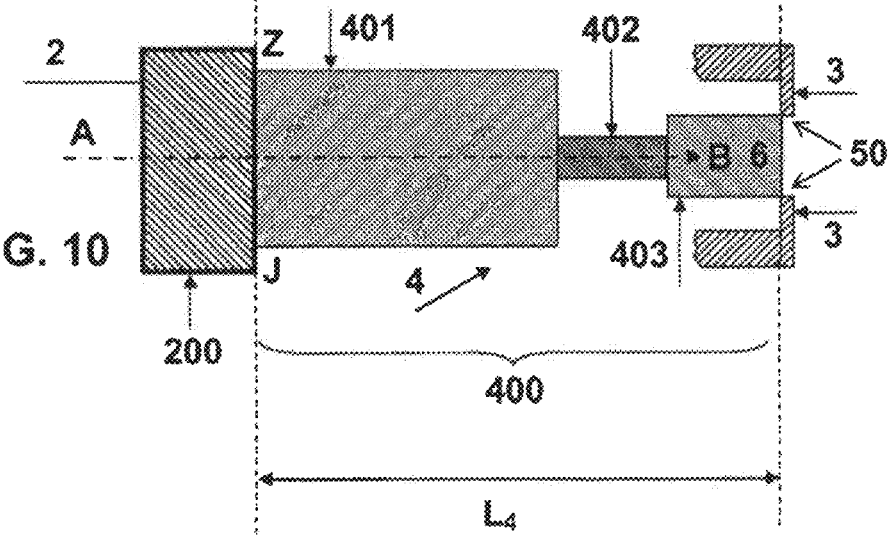
Figures 11, 12:
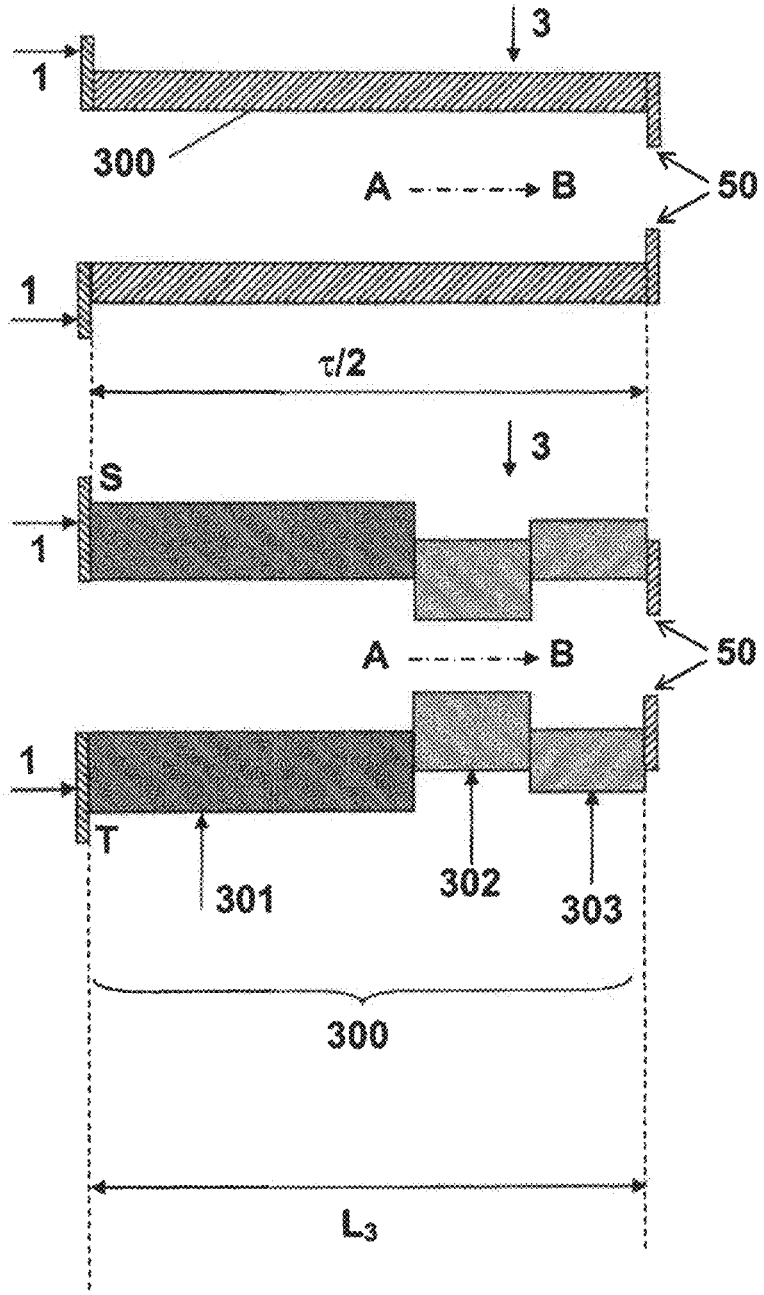
Figure 13:
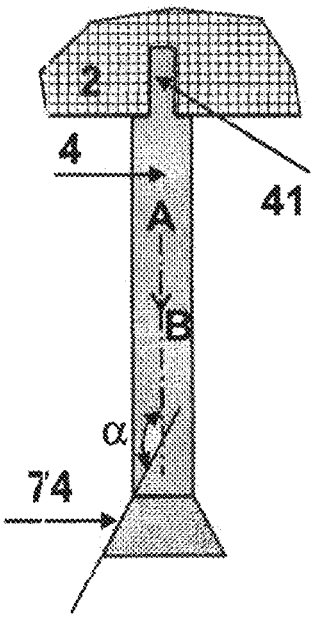
Figure 14:
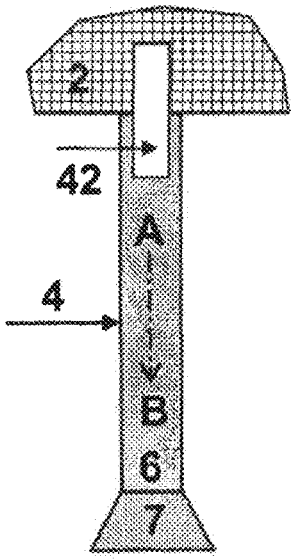
Figure 15:
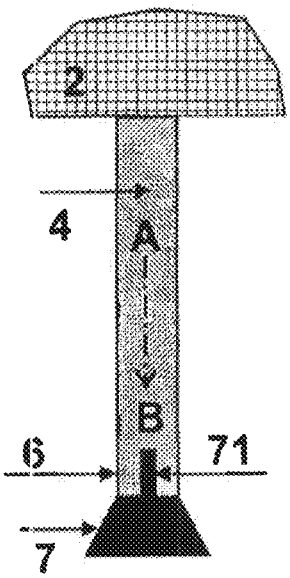
Figure 16:
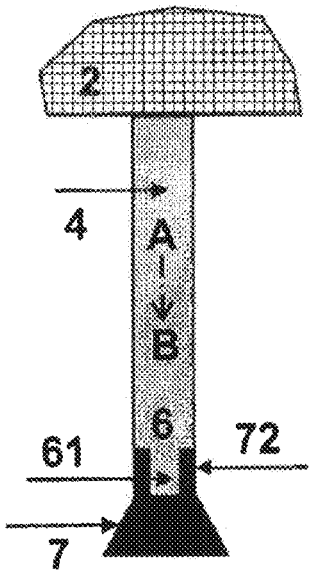
Figure 17:
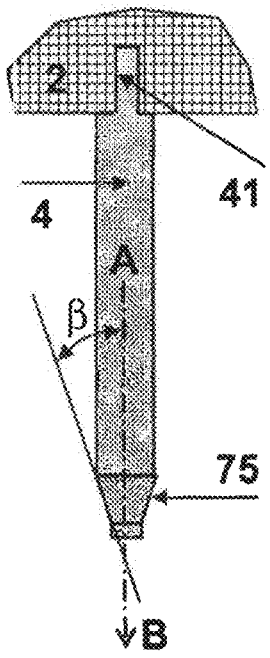
Figure 18:
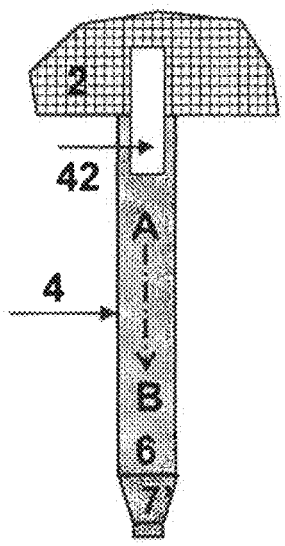
Figure 19:
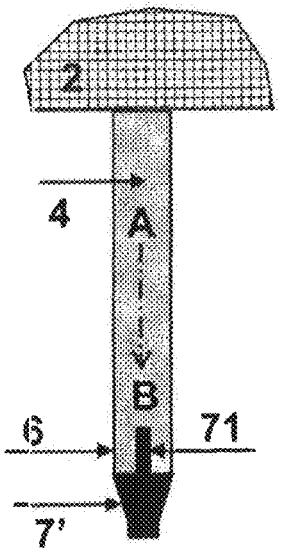
Figure 24:
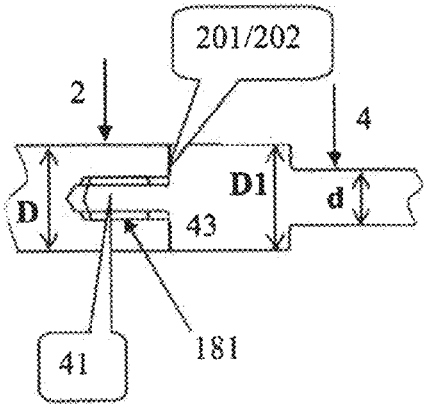
Figure 25:
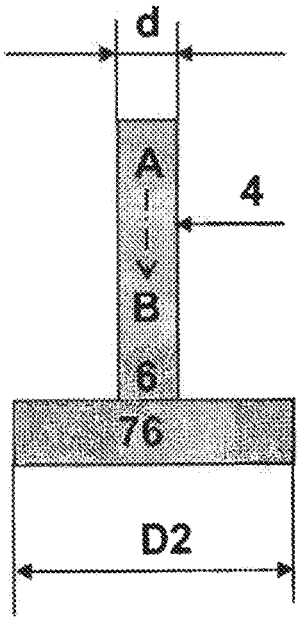
Figure 26:
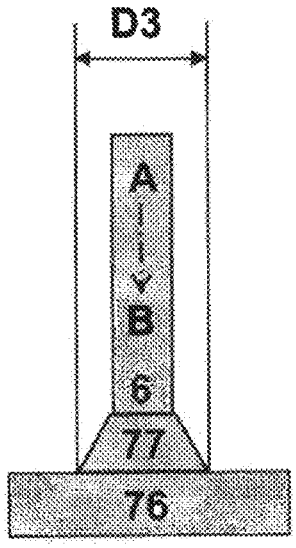
Figure 27:
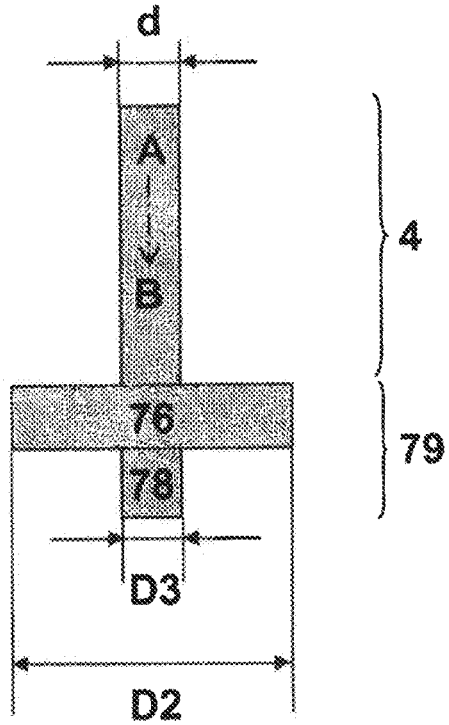

Other features and advantages of the invention will clearly emerge from the following description given thereof, as an indication and in no way limiting, with reference to the appended drawings in which:

FIG. 1 is a diagram of an injection device according to the invention arranged in an engine and fitted with a needle with an outgoing head connected to a second body comprising a second actuator, FIG. 2 is a diagram of an injection device according to the invention arranged in an engine and fitted with a needle with an incoming head connected to the second body comprising the second actuator, FIG. 3 is a diagram of an injection device according to the invention arranged in an engine, fitted with a needle with an outgoing head and with a first body comprising a first actuator, FIG. 4 is a diagram of an injection device according to the invention arranged in an engine, fitted with a needle with an incoming head and with the first body comprising the first actuator, FIGS. 5 and 6 represent diagrams illustrating an operation of the valve element formed by a nozzle and a needle with an outgoing head: valve element closed (FIG. 5); valve element open (FIG. 6), FIGS. 7 and 8 represent diagrams illustrating an operation of the valve element formed by a nozzle and a needle with an incoming head: valve element closed (FIG. 7); valve element open (FIG. 8), FIGS. 9 and 10 represent respectively schematically in a simplified side view in partial longitudinal section: a one-piece needle in the shape of a cylindrical bar (FIG. 9); a composite needle comprising three segments (FIG. 10), FIGS. 11 and 12 represent respectively schematically in a simplified side view in partial longitudinal section: a cylindrical one-piece nozzle (FIG. 11); a composite nozzle comprising three segments (FIG. 12), FIGS. 13-16 represent various assembly diagrams relating to the needle with outgoing head, FIGS. 17-20 represent various assembly diagrams relating to the needle with incoming head, FIGS. 21-24 represent various diagrams of assembly between a needle and the second actuator, FIGS. 25-26 represent schematically, in side view, variants of the needle with outgoing head, FIG. 27 represents schematically in side view a variant of the needle with incoming head.

An injection device, or injector, of FIG. 1, 3 (or 2, 4) is designed to inject a fluid, for example a fuel C, into a combustion chamber 15 of an internal combustion engine M or into an air intake duct, not shown.

The injector comprises two bodies which are for example cylindrical. A first body 1 representing a casing is extended, on a preferred axis AB of the injection device, for example, its axis of symmetry, by at least one nozzle 3 having a length on the axis AB and comprising an injection orifice and a seat 5 (or 5'). The linear dimensions of the first body 1, for example its width measured perpendicularly to the axis AB and/or its length measured along the axis AB, may be greater than those of the nozzle 3. The density of the first body 1 may be greater than that of the nozzle 3. The first body 1 may be connected to at least one circuit 130 of fuel C via at least one opening 9. The circuit 130 of fuel C comprises a device 13 for treating the fuel C comprising, for example, a tank, a pump and a filter.

A second body 200 is mounted so as to be able to move axially in the first body 1. A needle 4 has, on the axis AB, a length and a first end 6 defining a valve element, in a zone of contact with the seat 5 (or 5') of the nozzle 3. The linear dimensions of the second body 200, for example its width measured perpendicularly to the axis AB and/or its length measured along the axis AB, may be greater than those of the needle 4. The density of the second body 200 may be greater than that of the needle 4. The needle 4 and the second body 200 are connected together by a zone of junction ZJ (FIG. 3). The first end 6 is preferably extended along the axis AB by a head 7 (or 7') closing off the seat 5 (or 5') so as to ensure a better seal of the valve element of the injector. Return means 11 (or 11') of the second body 200 may be provided to keep the head 7 (or 7') of the needle 4 pressing against the seat 5 (or 5') of the nozzle 3. Therefore, the return means 11 (or 11') close the valve element whatever the pressure in the combustion chamber 15. The location of the point of application of the return forces on the second body 200 is of no consequence. The return means 11 (or 11') may be represented by a prestressed coil spring placed on the axis AB downstream of the second body 200 (FIGS. 1, 3) or upstream of the second body 200 (FIGS. 2, 4) relative to the direction of flow of the fuel C to the nozzle 3. The return means 11 (or 11') may also be formed by a fluidic means, for example of the hydraulic cylinder type, with the fuel C as the working liquid. The clearances due to the expansions of the various elements of the first body 1 are thus advantageously taken up by the return means 11 (or 11') so that the flow rate of the fuel C tends to remain insensitive to the heat variations during the various operating speeds of the engine M.

In addition, the injector comprises vibration means for vibrating with a setpoint period $\tau$ the first end 6 and/or the nozzle 3, thus ensuring between them, on said axis (AB), a relative movement suitable for opening and closing the valve element alternatively, as illustrated in FIGS. 5-6 and 7-8. The vibrations operate with a predetermined frequency $\upsilon$, for example an ultrasonic frequency that may range from approximately $\upsilon$=20 kHz to approximately $\upsilon$=60 kHz, that is to say with a setpoint period $\tau$ of the vibrations respectively of between 50 microseconds and 16 microseconds. As an example, a wavelength $\lambda$ of vibrations is approximately $10^{-1}$ m at $\upsilon$=50 kHz ($\tau$=20 microseconds).

According to the embodiment shown in FIG. 3 (or 4), the first body 1 comprises an actuator, called the first actuator 20, forming a portion of the vibration means, and suitable, with the first body 1 and the nozzle 3, for transmitting the vibrations to the seat 5 (or 5') of this nozzle 3. In this embodiment, the vibration means comprise an electroactive core 141, called the first electroactive core, placed in order to act on the first actuator 20 and means 14 for exciting the first electroactive core 141 that are suitable to make it vibrate with the setpoint period $\tau$.

According to the embodiment shown in FIG. 1 (or 2), the second body 200 comprises an actuator, called the second actuator 2, forming a portion of the vibration means, and extended along the axis AB by the needle 4, and suitable, with the second body 200 and the needle 4, for transmitting the vibrations to the first end 6 of this needle 4. In this embodiment, the vibration means comprise an electroactive core 141, called the second electroactive core, placed in order to act on the second actuator 2 and means 14 for exciting the second electroactive core 141 that are suitable for making it vibrate with the setpoint period $\tau$.

According to another embodiment not illustrated which represents a combination of two preceding modes, the injector may comprise both the first and the second actuators suitable, with respectively, on the one hand, the first body 1 and the nozzle 3, and, on the other hand, the second body 200 and the needle 4, for transmitting the vibrations respectively both to the seat 5 (or 5') of the nozzle 3 and to the first end 6 of the needle 4.

Preferably, the first and/or the second electroactive cores 141 may be made with the aid of a piezoelectric material. The selective deformations of the latter, for example, the periodic deformations with the setpoint period $\tau$, generating the acoustic waves in the injector finally culminate in the relative movement of the head 7 (or 7') relative to the seat 5 (or 5') or vice versa, suitable for alternatively opening and closing the valve element, as specified hereinabove with reference to FIGS. 5-6 and 7-8. These selective deformations are controlled by the corresponding excitation means, for example, with the aid of an electric field created by a potential difference applied to electrodes secured to the piezoelectric material. Alternatively, the first and/or the second electroactive cores 141 may be made with the aid of a magnetostrictive material. The selective deformations of the latter are controlled by the corresponding excitation means, for example, with the aid of a magnetic induction resulting from a selective magnetic field obtained with the aid, for example, of an exciter not represented and, in particular, by a coil secured to the second body 200.

The result of the above developments is that the nozzle 3 with the first body 1 and the needle 4 with the second body 200 form respectively a first and a second media for propagation of acoustic waves. The acoustic properties of each of these two media along the axis AB may be represented with the aid of an acoustic impedance I which depends, for example, for each section of the medium perpendicular to the axis AB, on a geometry of the medium and, in particular, on a surface $\Sigma$ of the section of the medium perpendicular to the axis AB, on a density $\rho$ of the medium and on a velocity c of the sound in the medium: $I=f(\Sigma, \rho, c)$. To illustrate this ratio, let us examine various simplified examples relating to the needle 4 or the nozzle 3 and illustrated respectively in FIGS. 9-10 and 11-12. For the purposes of simplification, it is understood that, for all these examples, the injector is furnished with a single second actuator 2 indistinguishable from the second body 200. In order to obtain an opening of the valve element of the injector that is not very sensitive to the pressure in the combustion chamber 15, the injector controls in movement the first end 6 of the needle 4, while the seat (represented in a simplified manner in FIGS. 9-12 and bearing reference 50) of the nozzle 3 is held dynamically immobile or fixed while thus behaving like a vibration node.

The needle 4 and the nozzle 3 are each shown as a body the radial dimensions of which perpendicular to the axis AB are small relative to its length along the axis AB. In a solid bar 400 cited here as a simplified model of the needle 4 (FIG. 9) or in a longitudinally pierced bar 300 cited here as a simplified model of the nozzle 3 (FIG. 11), the propagation of the acoustic waves links the propagation of a stress jump $\Delta\sigma$ and a speed jump $\Delta v$ with the aid of an equation: $\Delta\sigma=\Sigma*z*\Delta v$, where $\Sigma$ is a surface of a section of the bar perpendicular to its preferred axis, for example, its axis of symmetry, z is an acoustic impedance defined by an equation: $z=\rho*c$ where $\rho$ is a density of the bar and c is a velocity of the sound in the bar. It is understood that the stress $\sigma$ is positive for a compression and the speed v is positive in the direction of propagation of the incident acoustic waves, that is to say the acoustic waves initiated by the actuator 2 and oriented toward the first end 6 of the needle 4. The product $I=\Sigma*z=\Sigma*\rho*c$ representative of the acoustic properties of the bar—solid or hollow—is called in what follows "acoustic linear impedance" or "linear impedance".

Any variance in linear acoustic impedance I induces an echo, that is to say a weakening of the acoustic wave being propagated in a direction of the bar (for example, from right to left in FIGS. 9, 11) by another acoustic wave being propagated in the reverse direction of the bar (for example, from left to right in FIGS. 9, 11) from a point of variation of linear impedance I, for example, at a junction between the needle 4 and the actuator 2 (FIG. 9) or at another junction between the nozzle 3 and the first body 1 (FIG. 11). This same reasoning can be applied to any linear impedance breakage I, the term "breakage" having to be understood as "a linear impedance variation I exceeding a predetermined threshold representative of a difference between the linear impedance upstream and that downstream, relative to the direction of propagation of the acoustic waves, of a predetermined zone, called zone of linear impedance breakage, situated in a medium of acoustic wave propagation and separating this medium into at least two portions with different acoustic properties".

The injector comprises at least one zone of linear acoustic impedance breakage existing at a distance from the zone of contact of the seat 50 with the first end 6 of the needle 4 along the nozzle 3 (FIG. 11) or the first body 1, and at least one other zone of linear acoustic impedance breakage existing at a distance from the zone of contact of the first end 6 with the seat 50 along the needle 4 (FIG. 9) or the second body 200. Said zone and other zone of linear acoustic impedance breakage each being first in the order from said zone of contact between the first end 6 of the needle 4 and the seat 50, in a direction of propagation of the acoustic waves that is oriented respectively toward the first body 1 and second body 200.

As illustrated schematically in FIGS. 1 and 3 (or 2 and 4), the distance, called the first distance $L_3$, between on the one hand the zone of contact between the seat 5 (or 5') and the first end 6, and on the other hand the first zone of linear acoustic impedance breakage along the nozzle 3 or the first body 1, is such that the propagation time, called the "acoustic time-of-flight" $T_3$, of the acoustic waves initiated by the vibration means 2 and traveling over this first distance $L_3=f_3(T_3)$ satisfies the following equation:

$$T_3=n_3*[\tau/2] \quad \text{(E1)}$$

where $n_3$ is a multiplying coefficient, a non-zero positive integer, called the first multiplying coefficient, and the distance, called the second distance $L_4$, between on the one hand the zone of contact between the first end 6 and the seat 5 (or 5'), and on the other hand the first zone of linear acoustic impedance breakage along the needle 4 or the second body 200, is such that the propagation time, called the "acoustic time-of-flight" $T_4$, of the acoustic waves initiated by the vibration means 2 and traveling over this second distance $L_4=f_4(T_4)$ satisfies the following equation:

$$T_4=n_4*[\tau/2] \quad \text{(E2)}$$

where $n_4$ is another multiplying coefficient, a non-zero positive integer, called the second multiplying coefficient, for example, $n_4 \neq n_3$.

It should be understood that the equations referenced E1 and E2 above must be considered as verified to within a certain tolerance in order to take account of manufacturing constraints, for example, a tolerance of the order of plus or minus 10% of the setpoint period $\tau$, that is to say of the order of plus or minus 20% of the half-setpoint period $\tau/2$. Taking account of this tolerance, the equations referenced E1 and E2 above can be respectively rewritten as follows:

$$T_3=n_3*[\tau/2]*(1\pm0.2) \quad \text{(E1')}$$

$$T_4=n_4*[\tau/2]*(1\pm0.2) \quad \text{(E2')}$$

It should be noted that, in practice, the first distance $L_3=f_3(T_3)$ expressed as acoustic time-of-flight $T_3$ and the second distance $L_4=f_4(T_4)$ expressed as acoustic time-of-flight $T_4$, measured on corresponding parts manufactured on an industrial scale, may have slight variations relative to the reference values calculated with the aid of equations E1 and E2 above. These slight variations may be due to an effect of attached weights. The latter may correspond, for example, to the head 7 (or 7') of the needle 4 and/or a guide boss (not shown) in a plane perpendicular to the axis AB of the end 6 of the needle 4 in the nozzle 3. Said tolerance makes it possible to take account of said effect of attached weights so as to correct the expressions in acoustic time-of-flight of the first and of the second distances with the aid of the equations E1' and E2' above respectively as follows:

$$L_3=f_3(T_3)=f_3(n_3*[\tau/2]*(1\pm0.2))$$

$$L_4=f_4(T_4)=f_4(n_4*[\tau/2]*(1\pm0.2))$$

Preferably, $n_3=n_4$ for the first and the second multiplying coefficients where in particular $n_3=n_4=1$ in order to minimize the linear dimensions of the injector on the axis AB to leave as much space as possible for the inlet and/or exhaust ducts. Therefore, beginning from the zone of contact between the seat 5 (or 5') and the first end 6 of the needle 4, the nozzle 3 has constant acoustic properties over successions of length representative of the first distance $L_3=f_3(T_3)$ that are substantially equal to one another in acoustic time-of-flight and of which the expression in acoustic time-of-flight $T_3$ preferably amounts to a single half-setpoint period $\tau/2$. Similarly, beginning from the zone of contact between the seat 5 (or 5') and the first end 6 of the needle 4, the latter has constant acoustic properties over successions of length representative of the second distance $L_4=f_4(T_4)$ that are substantially equal to one another in acoustic time-of-flight and of which the expression in acoustic time-of-flight $T_4$ preferably amounts to a single half-setpoint period $\tau/2$.

To make it easier to assemble, over at least 90% of the first distance $L_3=f_3(T_3)$, the injector may have a variation in linear acoustic impedance that is less than or equal to 5% without this variation being able to be considered a linear acoustic impedance breakage. Similarly, over at least 90% of the second distance $L_4=f_4(T_4)$, the injector may have another variation in linear acoustic impedance that is less than or equal to 5% without this variation being able to be considered a linear acoustic impedance breakage.

During an established speed of its operation, that is to say during operation at a predetermined temperature excluding starting and stopping phases of the injector, the latter advantageously makes it possible to alternatively open and close the valve element in a manner that is not very sensitive to the pressure in the combustion chamber 15. In the example illustrated in FIG. 1 representing the case with a single second actuator 2 linked to the needle 4, it involves both controlling the movement of the first end 6 extended by the head 7 of the needle 4 and in keeping the seat 5 of the nozzle 3 dynamically immobile. As mentioned above, the movement control of the head 7 of the needle 4 takes place by virtue of the selective deformations, for example, periodic deformations with the setpoint period $\tau$ of the second electroactive core 141, transmitted to the needle 4 by means of the second actuator 2. The seat 5 is kept dynamically immobile by virtue of keeping its longitudinal speed on the axis AB equal to zero, taking advantage of the periodicity of the phenomenon of acoustic wave propagation. Each closure of the valve element during the periodic landings with the setpoint period $\tau$ of the head 7 of the needle 4 on the seat 5 produces an impact. The latter generates an acoustic wave, called an incident wave, associating a jump in speed $\Delta v$ and a jump in stress $\Delta\sigma$. This wave is propagated in the nozzle 3 toward the first body 1 while traveling the first distance $L_3$, and is then reflected in the first zone of linear acoustic impedance breakage which is indistinguishable, in FIG. 1, from a location of fitment of the nozzle 3 into the casing 1 with a section, in a plane perpendicular to the axis AB, that is much larger than that of the nozzle 3. Once the incident wave has been reflected, its echo, called the reflected wave, returns to the nozzle 3 in order to travel the first distance $L_3$ in the reverse direction, that is to say from the first body 1 to the seat 5. The reflected wave has the same sign of the jump in stress $\Delta\sigma$ as the incident wave and the inverse sign of the jump in speed $\Delta v$ as the incident wave. Taking it into account that the first distance is preferably conditional upon the equation: $L_3=f_3(T_3)=f_3(n_3*[\tau/2])$, the reflected wave reaches the seat 5 at exactly the same moment as a new incident wave is produced by the impact due to the closure of the valve element, the movement of the head 4 of the needle 4 also being conditional upon the second distance $L_4$ preferably dependent on a multiple of the half-setpoint period $\tau/2$: $L_4=f_4(T_4)=f_4(n_4*[\tau/2])$. The result of this is that, in the seat 5, the stresses are maintained and the speeds are canceled out. The seat 5 therefore has a vibration node. In these conditions, a variation in the pressure in the combustion chamber 15 will induce an amplification of the impacts but without changing their synchronism. The operation of the injector will therefore not be affected by this pressure variation in the combustion chamber 15.

In order to obtain the identity of the jumps in stress $\Delta\sigma$ when the two corresponding waves, the incident and reflected waves, cross, the reflection of the acoustic waves at the first zone of impedance breakage must be as large as possible, and even preferably total. This total reflection condition is a priori satisfied for the nozzle 3 set into the casing 1 associated in its turn with a cylinder head 8, this configuration being able to be similar to an ideal case of a bar of finite diameter set into an infinite body. Because of the finite size of the actuator 2, the total reflection of the acoustic waves in the zone of junction ZJ between the needle 4 and the actuator 2 (or the second body 200) is difficult to obtain. Suppose that, in the zone of junction ZJ, the second body 200 has a linear acoustic impedance $I_{AC-ZJ}$ and the needle 4 has a linear acoustic impedance $I_{A-ZJ}$ (FIG. 3). A satisfactory compromise in terms of virtually total reflection of the acoustic waves in the zone of junction ZJ may be obtained if the ratio $I_{AC-ZJ}/I_{A-ZJ}$ is greater than a predetermined value. Preferably, the following relation is verified: $I_{AC-ZJ}/I_{A-ZJ} \geq 2.5$.

In the light of the details above, it should be understood that, in the general case for the first and the second multiplying coefficients such as $n_3 \neq n_4$, it is the incident waves and the reflected waves shifted by a few periods $\tau$ which compensate for one another in the seat 5 in order to render it dynamically fixed. It is possible for this compensation not to be total when, for example, the difference between $n_3$ and $n_4$ is greater than a predetermined value and/or a dissipation of the acoustic waves in the nozzle 3 (and, finally, of its linear acoustic impedance), exceeds a certain threshold. That is why the configuration of the injector with $n_3=n_4$ and, in particular, $n_3=n_4=1$, appears to be a priori more reliable acoustically and remains preferred relative to that in which $n_3 \neq n_4$.

It should be understood that the first distance $L_3=f(T_3)$ and the second distance $L_4=f(T_4)$ respectively with respect to the first "nozzle 3+first body 1" and the second "needle 4+second body 200" media for propagation of the acoustic waves are defined preferably with the aid of the respective acoustic time-of-flight $T_3=n_3*[\tau/2]$ and $T_4=n_4*[\tau/2]$, in an acoustic context. The latter is due to the presence of the (ultra) sonic vibrations of the setpoint period $\tau$, initiated by the electroactive core 141 of the actuator 2, as evoked above. In other words, the first distance $L_3=f(T_3)$ and the second distance $L_4=f(T_4)$ are between two acoustic limits. Generally, a first acoustic limit used to define both the first distance $L_3$ and the second distance $L_4$ is represented by one end of an assembly in question ("nozzle 3+first body 1" or "needle 4+second body 200"). In a simplified manner, it is possible to consider that this first acoustic limit is indistinguishable from the zone of contact between the first end 6 of the needle 4 (optionally extended axially by the head 7) and the seat 5 of the nozzle 3, as illustrated in FIGS. 1 and 2. The second acoustic limit specific to each of the two assemblies is represented by the respective first zone of linear acoustic impedance breakage I, as explained above. For example, the second acoustic limit may correspond to the location where the diameter of the assembly in question varies in a plane perpendicular to the axis AB, for example, at the zone of junction ZJ of the needle 4 with the actuator 2 or the location of recessing of the nozzle 3 in the casing 1 (FIG. 1, 2), it being understood that, in the zone of junction ZJ, the needle 4 and the actuator 2 are produced, for example, by machining in a monoblock part made of material preferably having the same density and the same velocity of sound, and that, in the location of recessing, the nozzle 3 and the casing 1 are made, for example, by machining in a monoblock part made of material preferably having the same density and the same velocity of sound. Specifically, the machining in a monoblock part presents the simplest solution to apply during the manufacture of said parts on an industrial scale.

However, in certain cases, the acoustic limits of the bodies may not correspond to the physical limits of the bodies, as shown by two examples below. As illustrated in FIG. 12, within the first medium of acoustic wave propagation, over said first distance $L_3$, there is a plurality of segments 301, 302, 303 differentiated from one another by at least two criteria out of the following three criteria specific to each of the segments 301, 302, 303: (a) geometry of the segment; (b) density $\rho$ of the segment; (c) velocity c of the sound in the segment, the segments 301, 302, 303 being such that their respective linear acoustic impedance—$I_{301}=\Sigma_{301}*\rho_{301}*c_{301}$; $I_{302}=\Sigma_{302}*\rho_{302}*c_{302}$; $I_{303}=\Sigma_{303}*\rho_{303}*c_{303}$—are equal: $I_{301}=I_{302}=I_{303}$. Therefore, irrespective of their respective linear dimensions, no interfering echo is generated in zones of junction between two respective segments: 301/302, 302/303, so that the first distance $L_3$ remains between the seat 50 and the recessing location ST of the nozzle 3 in the first body 1 (FIG. 12). Therefore it is possible to produce the nozzle 3 in different materials, by combining them so as to give the nozzle 3 locally and/or axially selective physical properties (other than acoustic properties), specific to each of the segments 301, 302, 303 (for example by improving their resistance to impacts, by reducing their mechanical wear and/or their thermal expansion etc.), provided that their acoustic properties along the axis AB represented by the respective linear acoustic impedances $I_{301}$, $I_{302}$, $I_{303}$ remain the same: $I_{301}=I_{302}=I_{303}$. As illustrated in FIG. 10, within the second medium of acoustic wave propagation, over said second distance $L_4$, there is a plurality of segments 401, 402, 403 differentiated from one another by at least two criteria out of the following three criteria specific to each of the segments 401, 402, 403: (a) geometry of the segment; (b) density $\rho$ of the segment; (c) velocity c of the sound in the segment, the segments 401, 402, 403 being such that their respective linear acoustic impedances—$I_{401}=\Sigma_{401}*\rho_{401}*c_{401}$; $I_{402}=\Sigma_{402}*\rho_{402}*c_{402}$; $I_{403}=\Sigma_{403}*\rho_{403}*c_{403}$—are equal: $I_{401}=I_{402}=I_{403}$. Therefore, irrespective of their respective linear dimensions, no interfering echo is generated in zones of junction between two respective segments: 401/402, 402/403, so that the second distance $L_4$ remains between the seat 50 and the zone of junction ZJ of the needle 4 in the actuator 2 (FIG. 10). Therefore it is possible to produce the needle 4 in different materials, by combining them so as to give the needle 4 locally and/or axially selective physical properties (other than acoustic properties), specific to each of the segments 401, 402, 403 (for example by improving their resistance to impacts, by reducing their mechanical wear and/or their thermal expansion etc.), provided that their acoustic properties along the axis AB represented by the respective linear acoustic impedances $I_{401}$, $I_{402}$, $I_{403}$ remain the same: $I_{401}=I_{402}=I_{403}$.

In another embodiment illustrated in FIGS. 1 and 3 (or 2 and 4), the zone of junction ZJ between the needle 4 and the second body 200 is formed on the side of the second body 200 by at least one section of the second actuator 2, the section having a circular cross section with a predetermined diameter, called the diameter D of the second actuator 2, measured in a plane perpendicular to the axis AB. The zone of junction ZJ between the needle 4 and the second body 200 is formed on the side of the needle 4 by at least one axisymmetric section with a predetermined diameter, called the diameter d of the needle 4, measured in a plane perpendicular to the axis AB. Preferably, the section of the actuator 2 and that of the needle 4 are made in material having identical density $\rho$ and velocity c of sound. The diameter D of the actuator 2 and the diameter d of the needle 4 are linked by the following inequality: $D/d \geq \sqrt{2.5}$. Advantageously, this ratio of diameters D/d corresponds to an acceptable "acoustic recessing" of the needle 4 in the actuator 2 (FIGS. 1, 2). By virtue of this acceptable acoustic recessing, an incident wave leaving the head 7 (or 7') of the needle 4 and reaching along the needle 4 in the zone of junction ZJ is reflected therein virtually totally, that is to say without significant losses of amplitude and/or of frequency that are capable of disrupting the opening and the closure of the valve element with the setpoint period of τ (and, therefore, the movement control of the head 7 (or 7') of the needle 4 evoked above).

Figure 20:
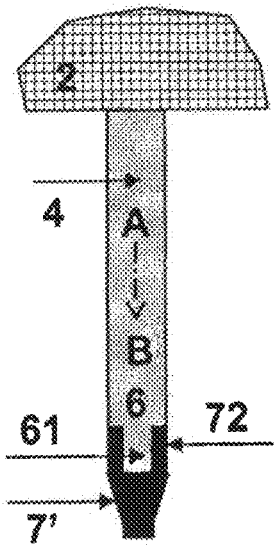
Figure 21:
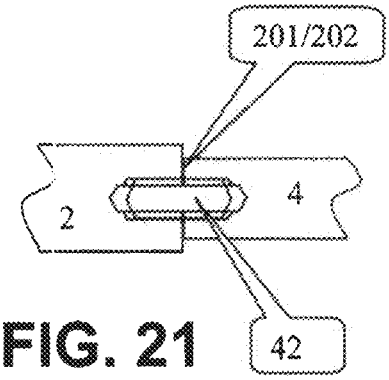
Figure 22:
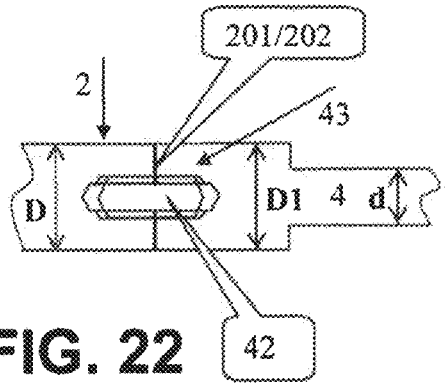
Figure 23:
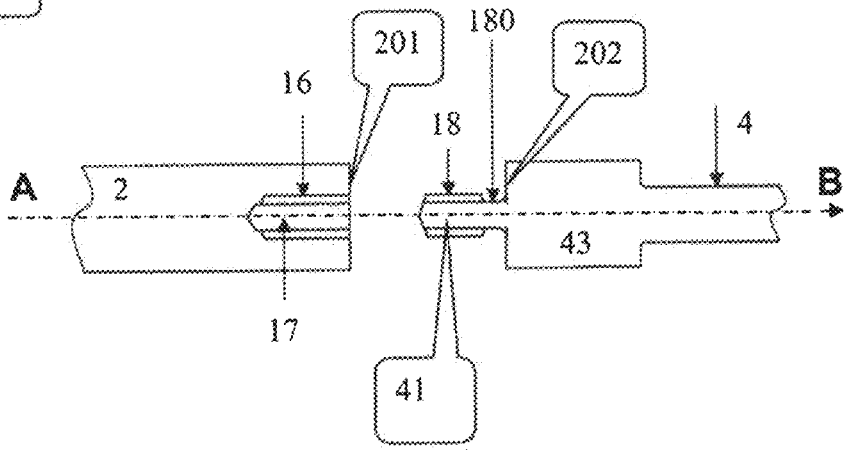

In certain cases, in order to assemble the injector, it is essential to insert the needle 4 separately from the second actuator 2 (and/or the needle 4 separately from the head 7 (or 7') of the needle 4) into the first body 1. Manufacturing as a single part or monoblock part the second actuator 2 with the needle 4 and/or the needle 4 with its head 7 (or 7') is then inappropriate. In order to assemble the injector in said situation, the second actuator 2 and the needle 4, on the one hand, and/or the needle 4 and the head 7 (or 7') of the needle 4, on the other hand, can be secured together with the aid of a "male/female" connection used to assemble said two parts. This connection can be obtained, for example, on the one hand, by a stud that is preferably central, that is to say aligned on the axis AB, and forming a screw, preferably a threaded screw, and, on the other hand, by a drill hole, that is preferably central, that is to say aligned on the axis AB and tapped (FIGS. 13-24). The stud may be secured to the needle 4 (see stud 41, called the first stud 41, in FIGS. 13, 17, 23-24 or stud 61 in FIG. 16), or to the second actuator 2, or to the head 7 (or 7'): see stud 71, called the second stud 71, in FIGS. 15, 19. "Secured studs"—of the needle 4, of the second actuator 2, of the head 7 (or 7')—as illustrated by reference numbers 41, 61, 71 in FIGS. 13, 17, 23-24, 16, 15, 19, must be understood in the broad sense, that is to say equally describing a "male" portion of said "male/female" connection, including the "male" portion being presented as a preferably threaded end obtained, for example, by a machining of the needle 4 or of the second actuator 2, or of the head 7 (or 7') and used to assemble the needle 4 with the second actuator 2 or the needle 4 with its head 7 (or 7'). The stud may also present itself as an independent part (see stud 42 independent of the needle 4 and of the second actuator 2 in FIGS. 14, 18, 21-22). The assembly of the actuator 2 with the needle 4 and/or of the needle 4 with its head 7 (or 7') requires a powerful acoustic coupling between them. This means an even distribution of the stresses over the surface of contact between the second actuator 2 and the needle 4 and/or the needle 4 and its head 7 (or 7'). For this, respective facing bearing surfaces of the second actuator 2 against the needle 4 (see the bearing surfaces 201 and 202 in FIGS. 21, 22, 24) and/or of the needle 4 against its head 7 (or 7') may have a determined smoothness and/or roughness, for example, less than 1 μm. The facing bearing surfaces are preferably perpendicular to the axis AB (FIGS. 21-24). Preferably, the threaded stud comprises at least one unthreaded portion. In an example relating to the second actuator 2 and the needle 4 (FIG. 23) with the stud 41 secured to the needle 4, the unthreaded portion 180 is placed downstream of the thread 18 relative to the direction of the axis AB. The unthreaded portion 180 makes it possible to leave a possibility of a slight rotation of the needle 4 about the axis AB in order to position the needle 4 on the second actuator 2 while controlling, during their assembly, a clamping force between their respective facing bearing surfaces 201, 202. In addition, the presence of the unthreaded portion 180 makes it easier to clear away a machining tool during the manufacture of the needle 4 in order to make it easier to produce the bearing surface 202 with the predetermined smoothness and/or roughness. In another example not illustrated in the figures and relating to the stud as an independent part, its unthreaded portion may be arranged at a predetermined distance from the ends of the stud, for example, in the middle of the stud. The needle 4 of diameter d may have at least one reinforced portion 43, for example axisymmetric, with a diameter D1 such that D1>d. The reinforced portion 43 could be immediately adjacent to the second actuator 2 of diameter D where preferably D1≤D (FIGS. 20-22). Preferably, the reinforced portion 43 is such that a variation of linear acoustic impedance I between this reinforced portion 43 and a remaining portion of the needle 4 is less than or equal to 5% without this variation being able to be considered as a linear acoustic impedance breakage. By virtue of this reinforced portion 43, the risks of breakage of the needle 4 in an immediate vicinity of the "male" portion (threaded screw 41, 18) induced by the connection to the stud 41 as illustrated in FIGS. 23-24 or of the "female" portion (nut 17, 16) induced by the connection to the stud 42 as illustrated in FIGS. 21-22, are minimized. Preferably, the stud and/or the corresponding drill hole is at least locally covered by a lubricating means 181 (FIG. 24), for example, at the thread 18 (see the exploded view in FIG. 23). The respective facing bearing surfaces of the second actuator 2 against the needle 4 and/or of the needle 4 against its head may in their turn be lubricated, covered by the lubricating means. At first sight, the effect of presence of the lubricating means would contribute to a separation of the second actuator 2 from the needle 4 and/or of the head from the needle 4. However, the presence of the lubricating means, in this instance, ensures a better structural continuity of the second actuator 2 with the needle 4 and/or of the head with the needle 4 by filling all the intermediate space (for example, between two threading grooves), which improves transmission of the acoustic waves. By virtue of the lubricating means, the closeness between the respective facing bearing surfaces of the second actuator 2 against the needle 4 and/or of the needle 4 against its head is increased. This makes it possible to prevent local variations of stresses due to the passing of the acoustic waves. In addition to its function as a filler, the lubricating means can also play a role as a bonding means which secures the second actuator 2 more with the needle 4 and/or the head with the needle 4. This transformation of the lubricating means into an "adhesive" is due, for example, to a physicochemical change in the lubricating means under the effect of the temperature in the combustion chamber 15.

In another embodiment, the first stud 41, the bearing surface 201 of the second actuator 2 against the needle 4 and the respective bearing surface 202 of the needle 4 against the second actuator 2 are covered with adhesive. Preferably, the second stud 71, a bearing surface of the first end 6 against the head 7 of the needle 4 and a respective bearing surface of the head 7 of the needle 4 against the first end 6 are covered with adhesive.

In another embodiment, the actuator 2 and the needle 4, on the one hand, and/or the needle 4 and its head 7, on the other hand, are acoustically secured together by bonding, preferably, with no stud or drillhole.

In a preferred mode of the injection device, the head 7, called outward facing, of the needle 4 is flared in the direction of the axis AB oriented toward the outside of the nozzle 3 in a plane perpendicular to the axis AB (FIGS. 1 and 3) and closes off the seat 5 on the outside of the nozzle 3 oriented away from the second actuator 2. The head 7 may be of a shape diverging toward the outside of the nozzle 3 in the direction of the axis AB. As an illustration, FIGS. 1, 3, 5-6, 13-16 show the divergent head 7 of frustoconical shape. Other divergent shapes of the head 7 can be envisaged, for example, a shape of the head not shown in the figures, the diameter of which perpendicular to the axis AB increases exponentially on the axis AB toward the seat 5. Preferably, at least one lateral wall 74 (frustoconical in the example in FIG. 13) of the head 7 forms, with the axis AB, a predetermined angle α such that α>90°. In the case of the divergent, for example frustoconical, head 7, the seat 5 of the nozzle 3 is preferably of a respective shape diverging toward the outside of the nozzle 3 in the direction of the axis AB (FIGS. 1, 3, 5-6), for example frustoconical, in order to ensure a better seal of the injector with the closed valve element (FIG. 5). In this case, it should be understood that the first acoustic limit used to determine the first distance $L_4$ in relation to the second "needle 4+second body 200" medium for propagation of the acoustic waves, is taken half-way up the divergent frustoconical head 7 (FIGS. 1, 3). The same applies for the second distance $L_3$ in relation to the first "nozzle 3+first body 1" medium for propagation of the acoustic waves (FIGS. 1, 3). In a less preferred solution, the divergent frustoconical head 7 may be replaced by a flared head 76, for example, a cylindrical head in the shape of a disk of diameter D2 greater than the diameter d of the needle 4 and perpendicular to the preferred axis AB (FIG. 25). Between the end 6 of the needle 4 and the cylindrical head 76 it would be possible to insert a cylindrical, and even divergent portion 77, for example frustoconical, with a maximum diameter D3 like that of the outward-facing head 7 described above, such that d≤D3<D2 (FIG. 26).

Note that the second actuator 2 is mounted so as to be able to move axially relative to the casing 1 by means of the return means 11 (FIGS. 1 and 3). The latter are capable of deforming, for example, elastically, exerting a predetermined force for a very slight elongation, for example, less than 100 μm, so as to pull the head 7 of the needle 4 against the seat 5 of the nozzle 3 on the axis AB in order to ensure that the valve element closes irrespective of the pressure in the combustion chamber 15.

In another preferred mode (FIGS. 2, 4, 7-8, 17-20), the head 7', called inward-facing, of the needle 4 narrows in the direction of the preferred axis AB oriented toward the outside of the nozzle 3 and closes off the seat 5' on the inside of the nozzle 3 oriented toward the second actuator 2 (or the second body 200). The head 7' may be of a shape converging toward the outside of the nozzle 3 in the direction of the axis AB (FIGS. 2, 4, 7-8, 17-20). As an illustration, FIGS. 2, 4, 7-8, 17-20 show the convergent head 7' in frustoconical shape. Other convergent shapes of the head 7' may be envisaged, for example, a shape of the head not shown in the figures the diameter of which perpendicular to the axis AB diminishes exponentially on the axis AB toward the seat 5'. Preferably, at least one lateral wall 75 (frustoconical in the example in FIG. 17) of the head 7' forms, with the axis AB, a predetermined angle β such that: 0°<β<90°. In the case of the convergent head 7', for example frustoconical, the seat 5' of the nozzle 3 is preferably of a respective shape converging toward the outside of the nozzle 3 in the direction of the axis AB (FIGS. 2, 4, 7-8), for example frustoconical, in order to ensure a better seal of the injector with the closed valve element (FIG. 7). In this case, it should be understood that the first acoustic limit used to determine the first distance $L_4$ in relation with the second "needle 4+second body 200" medium for propagation of the acoustic waves is taken half-way up the convergent frustoconical head 7' (FIGS. 2, 4). The same applies for the second distance $L_3$ in relation with the first "nozzle 3+first body 1" medium for propagation of the acoustic waves (FIGS. 2, 4). In a less preferred solution, the needle 4 comprises a composite head 79 made in at least two portions. The first portion 76 is, for example, cylindrical in the shape of a disk of diameter D2 that is greater than the diameter d of the needle 4 and perpendicular to the preferred axis AB (FIG. 27). The second portion 78 placed downstream of the first portion 76 in the direction of the axis AB (oriented as above toward the outside of the nozzle 3) is cylindrical with a diameter D3 such that: D3<D2 where, preferably, D2≤d. Therefore, the composite head 79 in two portions narrows in the direction of the axis AB. The second portion 78 could have a convergent shape, for example, frustoconically convergent like that of the inward-facing head 7' described above.

Note that the second actuator 2 is mounted so as to be able to move axially relative to the casing 1 by means of the return means 11' (FIGS. 2 and 4). The latter are capable of deforming, for example, elastically, exerting a predetermined force for a very slight elongation, for example, less than 100 μm, so as to push the head 7' of the needle 4 against the seat 5' of the nozzle 3 on the axis AB in order to ensure that the valve element closes irrespective of the pressure in the combustion chamber 15.

In another embodiment, at least one of the casing 1, the needle 4, the nozzle 3, the head 7 (or 7') comprises at least one portion made, for example, of at least one material from: (a) treated steel; (b) titanium; (c) titanium alloy. These materials cited here as a nonlimiting illustration have satisfactory acoustic characteristics expanding at high temperatures in a limited manner and are little exposed to mechanical wear. Preferably, the nozzle 3 and, in particular, its seat 5 (or 5') are made of treated steel the mechanical strength of which is greater than that of titanium or of its alloy. The same applies for the head 7 (or 7') of the needle 4. As for the needle 4, it is preferably made of titanium or of a titanium alloy lighter than treated steel. However, the simplicity of production of a "head 7 (or 7')+needle 4" assembly in a single piece, for example, by simply machining the "head 7 (or 7')/needle 4" assembly in a single piece may cause a preference for a needle 4 made of steel, for example, of treated steel.

The invention claimed is:

1. A fluid injection device comprising:

a nozzle having a length on an axis and comprising an injection orifice and a seat, the nozzle being, at the opposite end on the axis, connected to a first body;

a needle having, on the axis, a length and a first end defining a valve element, in a zone of contact with the seat, the needle being, at the opposite end on this axis, connected to a second body mounted so as to move axially in the first body;

means for vibrating to vibrate with a setpoint period τ the nozzle, thereby ensuring between the first end and the nozzle, on the axis, a relative movement suitable for opening and closing the valve element alternatively, the nozzle with the first body and the needle with the second body respectively forming a first and a second media for propagating acoustic waves, each medium having a linear acoustic impedance defined by following equation: $I=\Sigma*\rho*c$, where Σ is a surface of a section of the medium perpendicular to the axis, ρ is a density of the medium, c is a velocity of the sound in the medium;

at least one zone of linear acoustic impedance breakage existing at a distance from the zone of contact of the seat with the first end along the nozzle or the first body, and at least one other zone of linear acoustic impedance breakage existing at a distance from the zone of contact of the first end with the seat along the needle or the second body; and the zone and other zone of linear acoustic impedance breakage each being first in the order from the zone of contact between the first end of the needle and the seat, in a direction of propagation of the acoustic waves that is oriented respectively toward the first body and second body;

wherein a first distance between the zone of contact between the seat and the first end, and the first zone of linear acoustic impedance breakage along the nozzle or the first body, is such that the propagation time of the acoustic waves initiated by the vibration means and traveling over this first distance satisfies following equation: $T_3=n_3*[\tau/2]$, where $n_3$ is a multiplying coefficient, a non-zero positive integer; and wherein a second distance between the zone of contact between the first end and the seat, and the first zone of linear acoustic impedance breakage along the needle or the second body, is such that the propagation time of the acoustic waves initiated by the vibration means and traveling over this second distance satisfies following equation: $T_4=n_4*[\tau/2]$, where $n_4$ is a multiplying coefficient, a non-zero positive integer.

2. The fluid injection device as claimed in claim 1, wherein, within the first medium of acoustic wave propagation, over the first distance, there is a plurality of segments, differentiated from one another by at least two criteria out of the following three criteria specific to each of the segments: (a) geometry of the segment; (b) density ρ of the segment; (c) velocity c of the sound in the segment, the segments, being such that their respective linear acoustic impedances are equal.

3. The fluid injection device as claimed in claim 1, wherein, within the second medium of acoustic wave propagation, over the second distance, there is a plurality of segments, differentiated from one another by at least two criteria out of the following three criteria specific to each of the segments: (a) geometry of the segment; (b) density ρ of the segment; (c) velocity c of the sound in the segment, the segments, being such that their respective linear acoustic impedances are equal.

4. The fluid injection device as claimed in claim 1, wherein the needle and the second body are connected together by a zone of junction which transmits the acoustic waves, wherein in the zone of junction the second body has a linear acoustic impedance $I_{AC-ZJ}$ and the needle has a linear acoustic impedance $I_{A-ZJ}$, and the following relation is verified: $I_{AC-ZJ}/I_{A-ZJ}\geq 2.5$.

5. The fluid injection device as claimed in claim 1, wherein the first body comprises an actuator, forming a portion of the vibration means, and suitable, with the first body and the nozzle, for transmitting the vibrations to the seat of this nozzle.

6. The fluid injection device as claimed in claim 5, wherein the vibration means comprises a first electroactive core placed in order to act on the first actuator and means for exciting the first electroactive core that are suitable to make it vibrate with the setpoint period τ.

7. The fluid injection device as claimed in claim 6, wherein the means for exciting the first electroactive core comprises a magnetic induction coil.

8. The injection device as claimed in claim 1, wherein the vibration means includes means for vibrating with a setpoint period τ the first end.

9. The fluid injection device as claimed in claim 8, wherein the second body comprises a second actuator forming a portion of the vibration means, and extended along the axis by the needle, and suitable, with the second body and the needle, for transmitting the vibrations to the first end of this needle.

10. The fluid injection device as claimed in claim 9, wherein the vibration means comprises a second electroactive core placed in order to act on the second actuator and means for exciting the second electroactive core that are suitable for making it vibrate with the setpoint period τ.

11. The fluid injection device as claimed in claim 10, wherein the means for exciting the second electroactive core comprises a magnetic induction coil.

12. The injection device as claimed in claim 9, wherein the zone of junction between the needle and the second body is formed on the side of the second body by at least one section of the second actuator, the section having a circular cross section with a predetermined diameter D of the second actuator, measured in a plane perpendicular to the axis, and the zone of junction between the needle and the second body is formed on the side of the needle by at least one axisymmetric section with a predetermined diameter d of the needle, measured in a plane perpendicular to the axis, and wherein the diameter of the actuator and the diameter of the needle are linked by the following inequality:

$$D/d\sqrt{2.5}.$$

13. The fluid injection device as claimed in claim 9, wherein the second actuator and the needle are secured with aid of a threaded stud.

14. The fluid injection device as claimed in claim 13, wherein the stud, a bearing surface of the second actuator against the needle, and a respective bearing surface of the needle against the second actuator are covered with adhesive.

15. The injection device as claimed in claim 1, wherein the first end of the needle is extended along the axis by a head which narrows along the axis toward the outside of the nozzle, and the head closes off the seat on the inside of the nozzle oriented toward the second body.

16. The fluid injection device as claimed in claim 15, wherein the first end and the head of the needle are secured with aid of a threaded stud.

17. The fluid injection device as claimed in claim 16, wherein the stud, a bearing surface of the first end against the head of the needle, and a respective bearing surface of the head of the needle against the first end are covered with adhesive.

18. The fluid injection device as claimed in claim 1, wherein the first end of the needle is extended along the axis by a head which is flared along the axis oriented toward the outside of the nozzle, and the head closes off the seat on the outside of the nozzle.

19. An internal combustion engine using the fluid injection device as claimed in claim 1.

* * * * *